United States Patent [19]

LaFay et al.

[11] Patent Number: 4,676,997

[45] Date of Patent: Jun. 30, 1987

[54] SAND CASTING PATTERN COATING COMPOSITIONS

[75] Inventors: Victor S. LaFay, Cincinnati, Ohio; Stephen L. Neltner, Alexandria, Ky.

[73] Assignee: The Hill-and-Griffith Company, Cincinnati, Ohio

[21] Appl. No.: 838,642

[22] Filed: Mar. 11, 1986

[51] Int. Cl.[4] ..... B44D 1/20

[52] U.S. Cl. ..... 427/134; 106/38.22

[58] Field of Search ..... 106/38.22, 38.24, 38.25; 427/133, 134

[56] References Cited

U.S. PATENT DOCUMENTS

| | | | |
|---|---|---|---|
| 2,885,360 | 5/1959 | Haden et al. | 106/38.24 |
| 2,901,361 | 8/1959 | Meisel | 106/38.23 |
| 4,508,628 | 4/1985 | Walker et al. | 252/8.5 M |

FOREIGN PATENT DOCUMENTS 2008171 5/1979 United Kingdom .

1602187 11/1981 United Kingdom .

*Primary Examiner*—Lorenzo B. Hayes

*Attorney, Agent, or Firm*—Kinney and Schenk

[57] ABSTRACT

Sand casting is an old art. In this molding process sand is compacted around a pattern and the pattern is removed, leaving a mold cavity the shape of the pattern. Molten metal can then be poured into the cavity to form the object. To increase the life of the mold, and to make removal of the pattern easier, the pattern must be coated with a protective material. Despite many available pattern coating compounds, mineral seal oil, and a mixture of mineral seal and clay, have been the commercial choices. But they are not without their disadvantages. The properties of mineral seal oil are not entirely desirable, particularly its low flash point and toxicity. Hereby the advantages of mineral seal oil-clay pattern coating compositions are retained without its detriments.

4 Claims, No Drawings

SAND CASTING PATTERN COATING COMPOSITIONS

BACKGROUND OF THE INVENTION

This invention pertains to the casting of metals in sand molds, and particularly to methods and materials for increasing the lives of the mold patterns which are employed therein.

The introduction of a molten metal into a cavity, or mold, where upon solidification, the resulting casting becomes an object whose shape was determined by the mold, is an old art. Equally as old is sand casting. In this molding process a wood, metal or plastic pattern is fabricated in the shape of the part to be produced. Sand is then compacted around the pattern in such a way that the top portion of the mold and the pattern can be removed, leaving a mold cavity the shape of the pattern. Molten metal is then poured into the mold cavity.

It is well known that to increase the life of a mold and to make the removal of the casting easier, the surfaces of the mold cavity must be coated with a protective material. In the case of sand castings however it is the pattern which must be coated. Prior art coating compositions however deal primarily with mold coatings rather than pattern coatings. Hence these materials will first be considered. A wide variety of mold coating compositions have been suggested, some as long ago as 1904. (See U.S. Pat. No. 772,440.) Most of these mold release agents contain a clay in one of its forms. For example, in 1925 a mold coating containing powdered fire clay, sodium silicate, and water was proposed in U.S. Pat. No. 1,561,561. Silica, alumina and vegetable oils are disclosed in U.S. Pat. No. 977,801. In U.S. Pat. No. 1,688,350 the method employed was to coat the mold surfaces with a mixture of fire clay and silica, and thereafter to treat the coating with crude oil.

As can be discerned from these early patents, clays were used either with water or with oils. Later developments involved the combination of clays with binders to yield mold coating compositions. Thus in Re 26,969 crystalline silica, alumina and the like were incorporated in binders such as colloidal silica sols, aluminum phosphate, or ethyl silicate. In U.S. Pat. No. 4,529,028 the binder was a resinous polymer. Bentonite and other clays were used as suspending agents for such refractory materials as fused silica or powdered zircon.

As pointed out in U.S. Pat. No. 4,443,259 coatings for foundry cores and molds are basically mold release agents. They are used to obtain smoother casting surfaces with fewer defects. In its simplest form, the patentee explains, such a coating is simply a suspension of bentonite, kaolin and other members of the montmorillonite group of clays in water.

As in the case of moldings, the use of sandcasting patterns is not without its own problems. The pattern surfaces erode and pit when successive mold cavities are produced using them. When such erosion occurs, molding sands have a greater tendency to adhere to the pattern when it is removed, affecting the mold cavity. Mineral seal oil and mineral seal oil-clay compositions appear to confer on sand casting patterns results not obtainable with other pattern coating materials. Accordingly in spite of available pattern coating compositions, mineral seal oil and mineral seal oil-clay coatings are still the commercial preference.

Even though mineral seal oil and mineral seal oil-clay mold coating compositions have been commercially successful, they are not without their disadvantages. Mineral seal oil is a petroleum distillate and a solvent. As such it has properties which are not entirely desirable, particularly a low flash point and some toxicity. Its flash point of 100° to 300° F. can lead to plant fires. Care must be excersized to avoid contact with strong oxidizing agents, open flames, and electric sparks. In addition its volatility is such that inhalation may cause local irritations, drowsiness, collapse, muscle twitching, coma, and, in some instances, pneumonia. By the practice of this invention the benefits of mineral seal oil-clay coating compositions are retained without its detriments.

SUMMARY OF THE INVENTION

As described in the background of this invention it is concerned with a method of protecting foundry molds from eroding and pitting during sand casting by preventing adherence of casting sand to surfaces of casting patterns. This method involves applying a refined oil-clay composition to the surfaces of a casting pattern in an amount sufficient to form a coating which prevents that adherence and affords that protection. By the practice of this invention the benefits of the mineral seal oil are retained while nullifying its inhalation and combustibility hazards. Rather than being a mineral seal oil-clay composition per se, the mold coating composition herein is an emulsified mineral seal oil, and the clay incorporated therein is an organophylic clay, included in the coating as such or as a clay-water dispersible amine mixture. The emulsion, then, is a 40/60 to 60/40 be weight oil-water emulsion.

DETAILED DESCRIPTION OF THE INVENTION

This invention is an improvement of the processes for coating sand casting patterns with a mineral seal oil, the oil being rendered nonhazardous by modification. The mineral seal oil modification contemplated involves forming an aqueous emulsion of the mineral seal oil using a water dispersible amine and a clay reactive therewith as emulsifiers. It will be appreciated that the amine and the clay react to form an organophylic clay, the quantity of organophylic being sufficient to stabilize the emulsion, generally two to five weight percent organophylic clay based on the weight of the mineral seal oil-water mixture. The mineral seal oil and water emulsion of this invention presents no volatility and no flash point problems. And in lieu of a clay and a dispersible amine, an organophylic clay can be used to stabilize the emulsion.

Organophylic clays for years have provided viscosities and suspending properties required of drilling muds. The mold coating composition of this invention borrows from this drilling mud art. Consequently organophylic clays themselves are well known. They are prepared by treating a clay with an amine or an amine salt. Usually the clay-amine reaction is effected by mixing a clay dispersion with about 50 to 200 milequivalents of amine per 100 grams of clay. Amines which can be incorporated in the emulsion, or which can be reacted with the clays to form organophylic emulsifying agents are high molecular weight straight chain and cyclic aliphatic amines. Desirable amines are those having six to twenty four carbon atoms in the alkyl chains, for example, hexyl amine, heptyl amine, decyl amine, undecyl amine, tridecyl amine, pentadecyl amine, heptadecyl amine, cetyl amine, and cyclic tertiary amines such as tall oil or cottonseed oil imidazolines as well as their salts.

The clays normally utilized in the preparation of organophylic clays and hence those preferred herein are those containing aluminum and magnesium atoms along with the silica which is characteristic of such clays. This includes such clays as bentonite, attapulgite, sepiolite and palygorskite, but excludes muscovite or mica and kaolinitic clays. Again, it will be appreciated that the organophylic clays can be prepared in situ. Thus, in addition to incorporating, say, octadecylammonium bentonite in a mineral seal oil-water mixture, bentonite and octadecyl amine acetate can be included to the mixture to form the desired emulsion.

Having given the teachings of this invention, it will now be illustrated by means of specific examples.

EXAMPLE 1

An emulsion is prepared using mineral seal oil and water to form following composition.

| Material | Parts by weight |
|---|---|
| Mineral seal oil | 4000 |
| Water | 4000 |
| Amine* | 200 |
| Bentonite | 200 |

*1-hydroxyethyl-2-tall oil imidazoline

The above materials, when mixed in an ordinary mixer, produce a stable emulsion which is not affected by cold or hot temperatures. When frozen, the material returns to a stable emulsion without separating. When used on the pattern face in a green sand molding facility the product gives excellent results.

Even though a desirable, stable emulsion is formed by the procedure of Example 1, at times it will be desirable to incorporate certain additives in the composition. This is illustrated by the example which follows.

EXAMPLE 2

Following the procedure of Example 1 a parting composition was made using the same materials plus additional ingredients to further improve the stability and application properties of the product. The ingredients were as follows:

| Materials | Parts by weight |
|---|---|
| Mineral seal oil | 4600 |
| Water | 4730 |
| Bentonite | 230 |
| Amine* | 230 |
| Isopropanol | 230 |
| Oleic acid | 100 |

*Amine = Octadecyl amine acetate

When used in an ordinary mixer, the foregoing ingredients produce a stable emulsion which is not affected by cold or hot temperatures. When frozen, the material returns to a stable emulsion without separating when applied to the pattern face in a green sand molding facility. The composition will wet the surface of the pattern with an improved effeciency.

EXAMPLE 3

Following Example 1 a pattern coating composition was prepared using additional ingredients.

| Material | Parts by weight |
|---|---|
| Mineral seal oil | 4550 |
| Water | 4550 |
| Diisopropanol | 230 |
| Hexamine | 340 |
| Attapulgite | 230 |
| Oleic acid | 100 |
| Isopropanol | 230 |

This composition has the advantage that it will require less mixing action in an ordinary mixer to form a stable emulsion.

EXAMPLE 4

Following Example 1 a sand casting pattern coating was prepared using the following ingredients:

| Material | Parts by weight |
|---|---|
| Mineral seal oil | 2000 |
| Water | 2000 |
| Isopropanol | 100 |
| Oleic acid | 50 |
| Organophylic clay* | 100 |

*Octadecylammonium bentonite

The foregoing materials when mixed in an ordinary mixer produce a stable emulsion which is not affected by cold or hot temperatures. When frozen, the material returns to a stable emulsion without separating. When used on the pattern face in a green sand molding facility the product gives excellent results, yielding castings which are extremely smooth.

EXAMPLE 5

A presently manufactured product in the industry has the following composition:

| Material | Weight (Parts) |
|---|---|
| Mineral seal oil | 970 |
| Oleic acid | 30 |

This product was tested by a commercial testing laboratory and was found to have a Flash Point of 129° to 135° C. The parting composition of Example 3 when similarly tested did not have a flash point on heating to 100° C., and at that point the water vapor extinguished the flame. As a pattern coating composition the formula of Example 3 was superior to that of Example 5 because of the inclusion of the clay-amine compound.

The foregoing examples are illustrations of the variety of outstanding sand casting partings which can be made by this invention. When coatings of say 100 mil to three-sixteenth inch thicknesses are applied adherence of sand to the removed pattern is so minimal that the resulting cavity is devoid of pits and deterioration. In addition the parting composition is neither toxic nor flammable. Traditionally solvent systems have been used as parting materials for pattern faces. These compositions generally consisted of an oil solvent along with organic additives such as oleic acid, waxes, paraffin, and the like. Their toxicity and flammability have been disadvantages. The emulsification of the mineral seal oil with amine-clay mixtures or organophylic clays overcome these disadvantages.

As the examples show various modifications are possible within the spirit of this invention. In addition to ingredients illustrated, such additives as surfactants, either anionic, cationic or nonanionic and other emulsifing agents can be employed. It has already been emphasized that either the organophylic clay or the amine and the clay can be incorporated in the composition during the mixing stage. It should also be pointed out that in the refining of crude petroleum the light distillate fraction contains naphtha and refined oils. The refined oils include kerosene, signal oil and mineral seal oil. Obviously, because of their close chemical relationship kerosene, fuel oil, and signal oils can be substituted for the mineral seal oil in this invention. These and other ramifications wills occur to those skilled in the art. Such variations are deemed to be within the scope of this invention.

What is claimed is:

1. In the method of protecting foundry molds from eroding and pitting during sand casting by preventing adherence of molding sand to mold pattern surfaces, wherein a refined oil is applied to the mold pattern surfaces in an amount sufficient to form a coating thereon which prevents that adherence of sand to the mold pattern, the improvement whereby the benefits of the refined oil are retained while nullifying its inhalation and combustibility hazards, the improvement comprising coating the mold pattern surfaces with combination of refined oil, water, a water dispersible amine, and a clay reactive with the amine to form an organophylic clay, the combination consisting of a refined oil-in-water emulsion coating with no flash point and volatility.

2. The process of claim 1 wherein the refined oil is mineral seal oil, the amine is an oil soluble, water dispersible monobasic cyclic tertiary amine and the clay reactive therewith is attapulgite.

3. The process of claim 1 wherein the dispersible amine and the clay are prereacted to form the organophylic clay.

4. The process of claim 3 wherein the organophylic clay is octadecyl ammonium bentonite.

* * * * *